US005078067A

United States Patent [19]

Nakashima

[11] Patent Number: 5,078,067

[45] Date of Patent: Jan. 7, 1992

[54] SEWING MACHING WITH ABNORMAL CONDITION WARNING MEANS FOR WARNING ABNORMAL CONDITION BY CHANGING COLOR OF LIGHT

[75] Inventor: Akifumi Nakashima, Ichinomiya, Japan

[73] Assignee: Brother Kogyo Kabushiki Kaisha, Nagoya, Japan

[21] Appl. No.: 697,982

[22] Filed: May 10, 1991

[30] Foreign Application Priority Data

Jul. 10, 1990 [JP] Japan ..... 2-183456

[51] Int. Cl.[5] ..... D05B 19/00; G08B 19/00; G08B 5/36; F21V 33/00

[52] U.S. Cl. ..... 112/121.11; 112/277; 112/278; 112/447; 340/691; 362/253

[58] Field of Search ..... 112/121.11, 277, 275, 112/273, 447, 278; 362/253; 340/679, 691

[56] References Cited

U.S. PATENT DOCUMENTS 3,898,383 8/1975 Herbits ..... 362/253
4,481,507 11/1984 Takiguchi et al. ..... 112/277 X
4,498,078 2/1985 Yoshimura ..... 112/277 X
4,554,879 11/1985 Eguchi ..... 112/277 X
4,649,376 3/1987 Frank ..... 340/691
4,763,589 8/1988 Laidig et al. ..... 112/278
4,967,676 11/1990 Hagino et al. ..... 112/277 X
4,994,792 2/1991 Ziegler, Jr. ..... 340/691 X

*Primary Examiner*—Peter Nerbun
*Attorney, Agent, or Firm*—Oliff & Berridge

[57] ABSTRACT

A sewing machine comprising a sewing machine lamp for illuminating an area around an end of a sewing needle, and a plurality of color filters provided on a rotary disk which is rotated by a stepping motor so that the area around the end of the sewing needle is illuminated by light of a selected one of a plurality of different colors. When an abnormal condition detector for detecting an erroneous operation or an abnormal condition such as an accident of the sewing machine detects an abnormal condition, an abnormal condition warning device changes the color of the illuminating light to a color corresponding to a type of the abnormal condition.

20 Claims, 8 Drawing Sheets

Fig.4C

| ITEM | INSTRUCTIONS |
|---|---|
| S1 | INITIALIZATION TURN SEWING MACHINE LAMP ON & POSITION TRANSPARENT FILTER |
| S2 | PREPARED FOR WINDING OF BOBBIN THREAD? |
| S3 | INDICATE " TO WIND BOBBIN THREAD" |
| S4 | STARTING / STOPPING SWITCH ON? |
| S5 | POSITION GREEN FILTER |
| S6 | START SEWING MACHINE MOTOR |
| S7 | STARTING / STOPPING SWITCH ON? |
| S8 | STOP SEWING MACHINE MOTOR |
| S9 | POSITION TRANSPARENT FILTER |
| S10 | STARTING / STOPPING SWITCH ON? |
| S11 | ERRONEOUSLY OPERATED? |
| S12 | WARNING INDICATION (ERASED AFTER FIXED TIME) |
| S13 | POSITION RED FILTER |
| S14 | ERRONEOUS OPERATION CORRECTED? |
| S15 | REMAINING BOBBIN THREAD SUFFICIENT? |
| S16 | INDICATE " REMAINING BOBBIN THREAD INSUFFICIENT " |
| S17 | POSITION YELLOW FILTER |
| S18 | POSITION GREEN FILTER (ERASE REMAINING BOBBIN THREAD INSUFFICIENT INDICATION) |
| S19 | POSITION TRANSPARENT FILTER AFTER LAPSE OF FIXED TIME |
| S20 | STARTING / STOPPING SWITCH ON? |
| S21 | START SEWING MACHINE MOTOR (SEWING) |
| S22 | REMAINING BOBBIN THREAD SUFFICIENT? |
| S23 | INDICATE " REMAINING BOBBIN THREAD INSUFFICIENT " |
| S24 | POSITION YELLOW FILTER |
| S25 | POSITION GREEN FILTER (ERASE REMAINING BOBBIN THREAD INSUFFICIENT INDICATION) |
| S26 | POSITION TRANSPARENT FILTER AFTER LAPSE OF FIXED TIME |

Fig.4D

| ITEM | INSTRUCTIONS |
|---|---|
| S27 | SEWING MACHINE LOCKED? |
| S28 | DEENERGIZE MACHINE MOTOR |
| S29 | WARNING INDICATION (ERASE AFTER LAPSE OF FIXED TIME) |
| S30 | POSITION RED FILTER |
| S31 | POSITION TRANSPARENT FILTER AFTER LAPSE OF FIXED TIME |
| S32 | REMAINING BOBBIN THREAD SUFFICIENT? |
| S33 | POSITION YELLOW FILTER |
| S34 | NEEDLE THREAD BROKEN? |
| S35 | STOP SEWING MACHINE MOTOR |
| S36 | WARNING INDICATION OF "NEEDLE THREAD BROKEN " (ERASE AFTER LAPSE OF FIXED TIME) |
| S37 | POSITION RED FILTER |
| S38 | POSITION TRANSPARENT FILTER AFTER LAPSE OF FIXED TIME |
| S39 | STARTING / STOPPING SWITCH ON? |
| S40 | STOP SEWING MACHINE MOTOR |
| S41 | POWER SOURCE OFF? |

SEWING MACHING WITH ABNORMAL CONDITION WARNING MEANS FOR WARNING ABNORMAL CONDITION BY CHANGING COLOR OF LIGHT

BACKGROUND OF THE INVENTION

1. Field of the Invention

This invention relates to a sewing machine with functions for performing pattern stitching, button hole stitching, automatic edge stitching and so forth, and more particularly, to a sewing machine provided with an abnormal condition warning means for giving a warning of an abnormal condition by changing a color of light.

2. Description of Related Art

Conventionally, in sewing machines of the type mentioned, when an operator makes an error in operation, when the remaining amount of bobbin thread decreases to a certain level or when a needle thread is broken, a control device indicates such information on an indicator to give a warning of the abnormal condition to the operator. Such an indicator may include a plurality of LED's, one of which is selectively lit corresponding to a message of an abnormal condition printed on a panel, or may include a liquid crystal display unit for displaying a message of an abnormal condition thereon. Such an indicator may include, as alternative means for giving a warning of an abnormal condition to an operator, a sound emitting device from which a message of an abnormal condition is generated by sound.

A sewing machine is disclosed in U.S. Pat. No. 4,763,589 wherein an LED provided at the sewing head is lit, when a bobbin thread is consumed to a certain low bobbin thread condition, thereby providing a warning to an operator.

Another sewing machine is disclosed in U.S. Pat. No. 4,481,507 wherein, when a needle thread is broken, a thread breakage detector detects such breakage and outputs a signal to a sound emitting device. More particularly, a thread breakage detector disposed along a supply route of the needle thread detects tension of the thread by means of a microswitch or an optical sensor. Such a signal is then transmitted to a microprocessor. The microprocessor outputs the signal to a sound emitting device, and consequently, the sound emitting device emits sounds representative of an abnormal location. For example, a warning message of an abnormal condition of "a thread is broken" can be given to an operator.

However, with sewing machines of such construction wherein an LED is energized to emit light or a message of an abnormal condition is displayed on a liquid crystal display unit, since the indicator is small in size, an operator may possibly not be made aware of such a message of an abnormal condition and may, therefore, repeat the same erroneous operation. On the other hand, with sewing machines of the construction wherein a message of an abnormal condition is developed by sound by a sounding emitting device, an operator sometimes misses the message of an abnormal condition thus developed by sound. Thus, in this instance as well, there is the possibility that the same erroneous operation may be repeated.

SUMMARY OF THE INVENTION

It is an object of the present invention to provide a sewing machine which can provide a warning of an erroneous operation or an abnormal condition with certainty to an operator.

It is another object of the present invention to provide a sewing machine which changes the color of light emitted from an illuminating means to provide a warning of an erroneous operation or an abnormal condition to an operator.

In order to attain the objects, according to the present invention, there is provided a sewing machine, which comprises a sewing needle, illuminating means for illuminating with light of different colors a sewing area defined on a bed in which a sewing operation is performed by an operator, detecting means for detecting an abnormal condition of the sewing machine, and color changing means for changing, upon detection of an abnormal condition by the detecting means, the color of light emitted from the illuminating means to provide a warning of such abnormal condition to an operator.

With the sewing machine, when an abnormal condition of the sewing machine is detected, the color of light emitted from the illuminating means for illuminating the sewing area is changed. Consequently, the operator will immediately be aware of the fact that the color of light has changed, and accordingly, an abnormal condition of the sewing machine will be recognized with certainty.

BRIEF DESCRIPTION OF THE DRAWINGS

A preferred embodiment of the present invention will be described in detail with reference to the following figures wherein:

FIGS. 4A and 4B are flowcharts illustrating operation of the sewing machine and FIGS. 4C and 4D are tables indicating the steps performed in the flowcharts of FIGS. 4A and 4B.

DETAILED DESCRIPTION OF THE PREFERRED EMBODIMENTS

In the following, the present invention will be described with reference to the drawings in connection with a preferred embodiment thereof wherein it is applied to a sewing machine having a function of performing pattern stitching, button hole stitching and automatic edge stitching.

Figure 2:
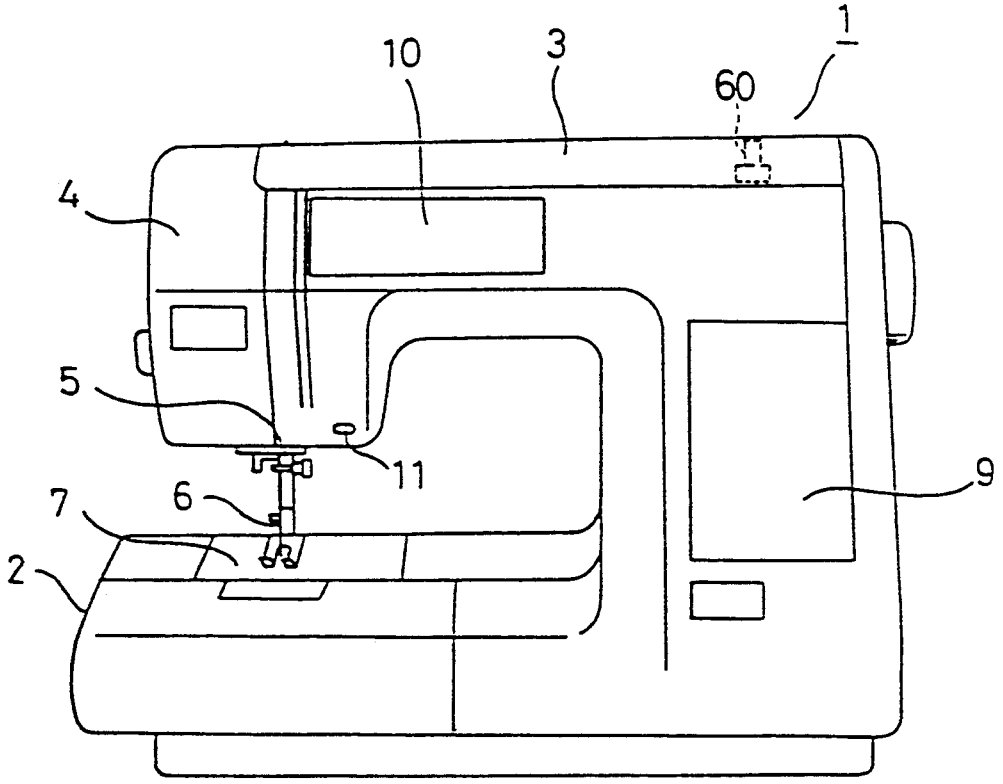
FIG. 2 is a perspective view showing general construction of the sewing machine.

First, the general construction of the sewing machine will be described briefly with reference to FIG. 2. A body 1 of the sewing machine includes a bed section 2 in the form of a substantially rectangular box, and an arm section 3 provided integrally on and extending leftwardly from a right upper portion of the bed section 2. A head 4 is formed at a left portion of the arm section 3, and a needle bar 5 is provided at a lower portion of the head 4 and extends downwardly. A sewing needle 6 is attached to a lower end of the needle bar 5. A bobbin thread winding shaft 60 for winding bobbin thread around a bobbin is provided at a right portion of the arm section 3. A throat plate 7 is mounted on an upper face of a left portion of the bed section 2 in an opposing relationship to the sewing needle 6. A horizontally rotating shuttle (not shown) for cooperating with the sewing needle 6 to form stitches is provided below the throat plate 7. A sewing machine motor 8 (refer to FIG. 3) serving as a driving source for a driving mechanism for driving the needle bar 5 and the horizontally rotating shuttle in a synchronized relationship with each other is disposed in the bed section 2. Meanwhile, an operation panel 9 is provided at a front face portion of an upright portion of the arm section 3. A pattern selecting switch and operation switches for activating various operations are disposed on the operation panel 9. Further, an indicating device 10 constituted of a liquid crystal display unit is provided at a front face portion of an upper portion of the arm section 3. A starting/stopping switch for starting or stopping the sewing machine motor 8 is provided at a lower portion of a front face portion of the head section 4 of the arm section 3.

Figure 1:
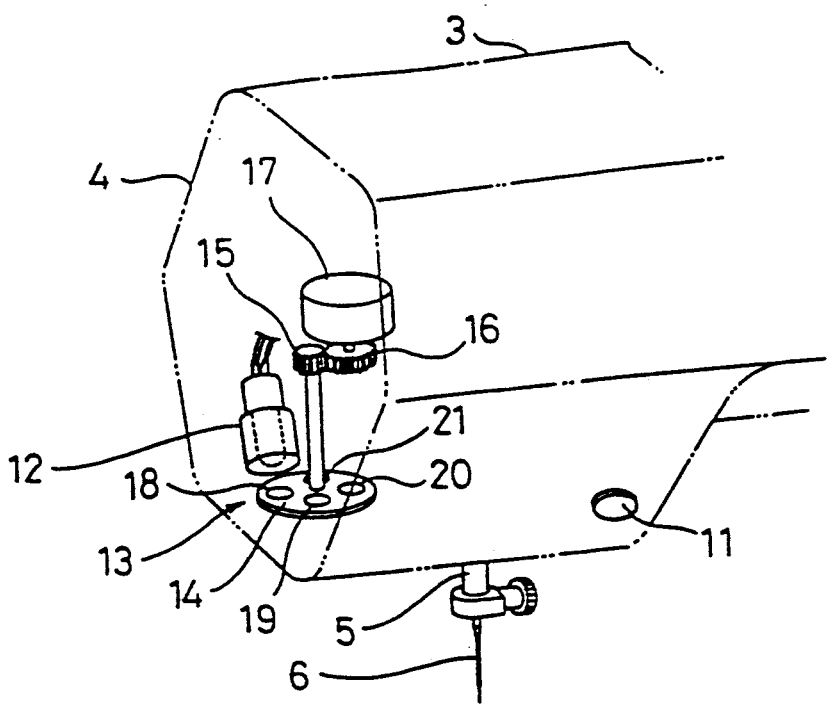
FIG. 1 is a perspective view of a sewing lamp, a color changing device and a sewing needle of a sewing machine showing an embodiment of the present invention.

Referring now to FIG. 1, a sewing machine lamp 12 serving as illuminating means is disposed on a machine frame in the inside of the head section 4. The sewing machine lamp 12 emits natural light, for example, white light and is disposed such that it may illuminate an area of and around an upper face of the throat plate 7, that is, an area around an end of the sewing needle 6, with such white light. A color changing device 13 is provided in the neighborhood of the sewing machine lamp 12. The color changing device 13 includes a disk 14 mounted for rotation, and a color changing motor 17 for driving the disk 14 to rotate by way of a pair of mutually meshing gears 15 and 16. The color changing motor 17 consists of a stepping motor. Transparent, red, yellow and green filters 18 to 21, respectively, are disposed in an equidistantly spaced relationship on a circumferential edge portion of the disk 14. In this instance, one of the four filters 18 to 21 is selectively positioned just below a light emitting portion of the sewing machine lamp 12 by rotation of the disk 14. Thus, the color of light emitted from the sewing machine lamp 12 is changed in accordance with the color of a selected one of the filters 18 to 21.

Figure 3:
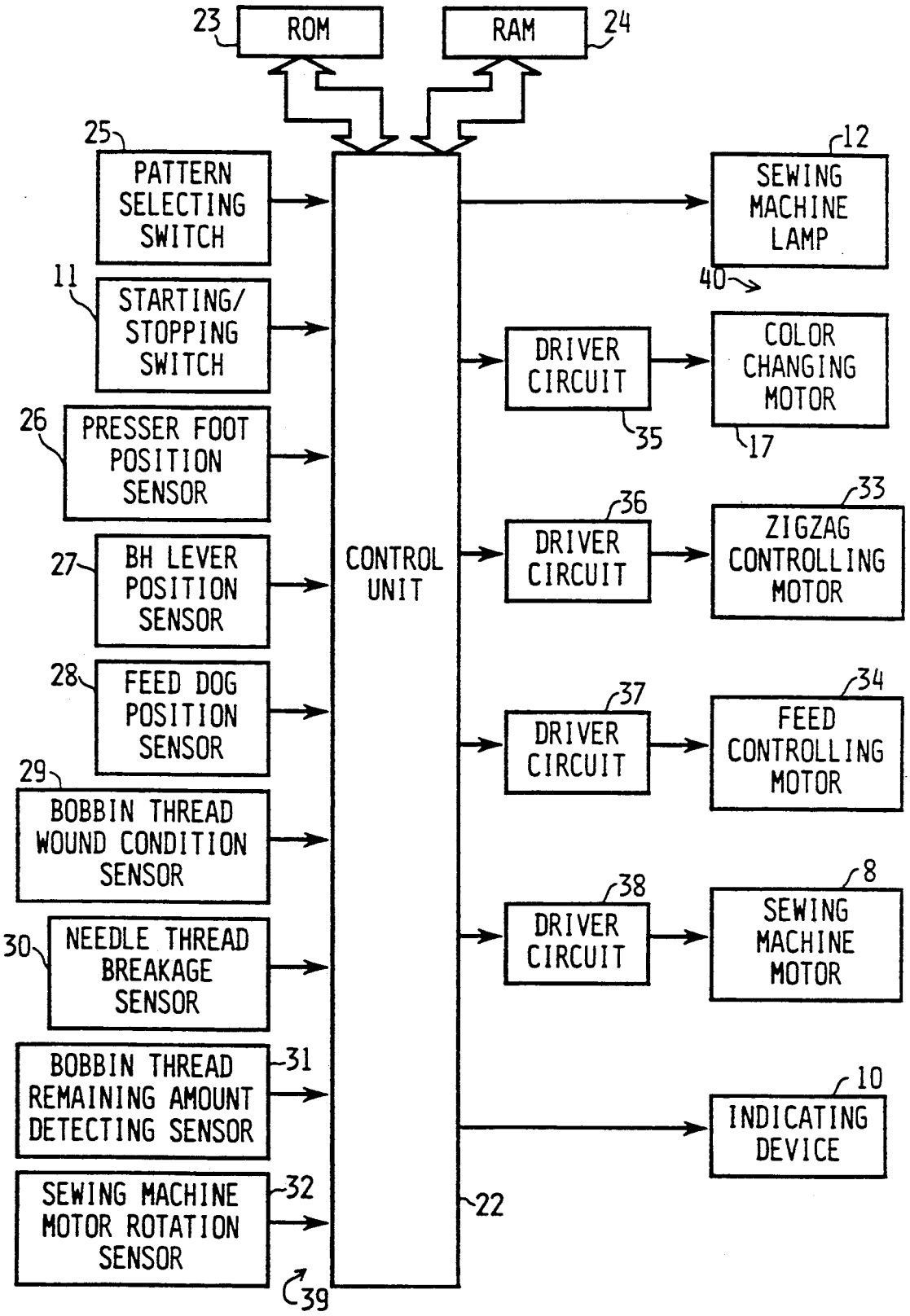
FIG. 3 is a block diagram showing construction of a control system of the sewing machine.

Referring now to FIG. 3, there is shown in block diagram the construction of a control system including, as a principal component, a control unit 22 for controlling operation of the sewing machine. The control unit 22 includes a microcomputer. A ROM 23 and a RAM 24 are connected to the control unit 22 by way of respective buses. A pattern selecting switch 25, the starting/stopping switch 11, a presser foot position sensor 26, a button hole (BH) lever position sensor 27, a feed dog position sensor 28, a bobbin thread wound condition sensor 29, a needle thread breakage detecting sensor 30, a bobbin thread remaining amount detecting sensor 31 and a sewing machine motor rotation sensor 32 deliver respective output signals to the control unit 22. The control unit 22 receives such signals from those elements and controls the sewing machine lamp 12 to be lit or extinguished. Further, the control unit 22 controls driving of the aforementioned color changing motor 17, a zigzag controlling motor 33, a feed controlling motor 34 and the sewing machine motor 8 by way of driver circuits 35 to 38, respectively, and further controls indication of the indicating device 10.

In the construction described above, the pattern selecting switch 25 is an operation switch for selecting a desired stitch pattern from among a large number of stitch patterns which can be sewn using the sewing machine. The starting/stopping switch 11 is provided for starting or stopping the sewing machine motor 8, and when the switch 11 is operated, the sewing machine motor 8 is started or stopped by way of the driver circuit 38. The presser foot position sensor 26 is provided for detecting an upper or lower position of the presser foot. The BH lever position sensor 27 is provided for detecting an upper or lower position of a BH lever (a change-over lever for button hole stitching). The feed dog position sensor 28 is provided for detecting an upper or lower position of the feed dog. The bobbin thread wound condition sensor 29 is provided for detecting whether or not a bobbin thread winding shaft 60 is prepared for winding of bobbin thread. The needle thread breakage detecting sensor 30 is provided for detecting a condition such that a needle thread is broken or a needle thread is not present. The bobbin thread remaining amount detecting sensor 31 is provided for detecting a remaining amount of bobbin thread. The sewing machine motor rotation sensor 32 is provided for detecting a rotating condition of the sewing machine motor 8. For example, when thread is entangled to cause the sewing machine motor to be locked, the sewing machine motor rotation sensor 32 detects such a locked condition of the sewing machine motor.

Meanwhile, the zigzag controlling motor 33 is provided for driving the needle bar 5 to move laterally in leftward and rightward directions. The feed controlling motor 34 is provided for driving the feed dog to move in forward and backward directions. Abnormal condition detecting means 39 is comprised of the switches 25 and 11, sensors 26 to 32 and control unit 22 of the construction described above. Thus, an erroneous operation or an abnormal condition of the sewing machine control unit 22 is detected by the abnormal condition detecting means 39.

Meanwhile, abnormal condition warning means 40 is comprised of the control unit 22 and color changing device 13.

Subsequently, operation of the sewing machine of the construction described above will be described below with reference to FIGS. 4A and 4B.

Figure 4A:
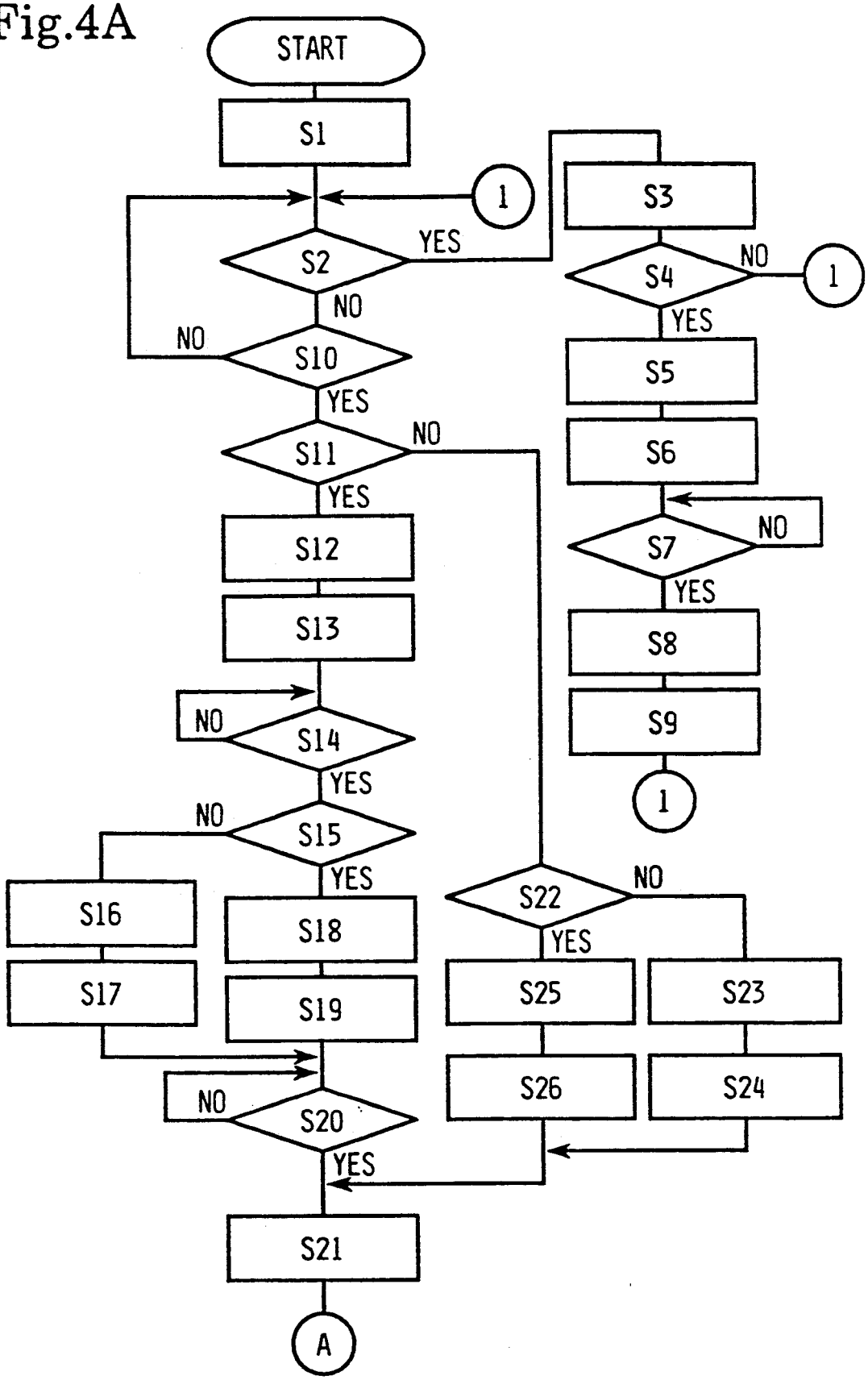

Referring first to FIG. 4A, if a power source switch (not shown) is turned on, then initially at step S1, the sewing machine lamp 12 is lit and the transparent filter 18 of the disk 14 of the color changing device 13 is positioned just below the light emitting portion of the sewing machine lamp 12. Consequently, an area of and around the upper face of the throat plate 7 is illuminated by natural light emitted from the sewing machine lamp 12 and transmitted through the transparent filter 18. At step S2, it is judged in accordance with a signal from the bobbin thread wound condition sensor 29 whether or not the bobbin thread winding shaft 60 is prepared for winding of bobbin thread. Here, if it is judged that the bobbin thread winding shaft 60 is prepared for winding of bobbin thread, then the control sequence advances to step S3 at which an indication of "to wind bobbin thread" is provided on the indicating device 10. At step S4, it is judged whether or not the starting/stopping switch 11 is in an on-state. When the judgment is NO, the control sequence returns to step S2. If the judgment is YES, however, then the green filter 21 of the disk 14 of the color changing device 13 is positioned just below the light emitting portion of the sewing machine lamp 12 at step S5. Consequently, natural light emitted from the sewing machine lamp 12 is transmitted through and changed by the green filter 21 into green light. Accordingly, the area of and around the upper face of the throat plate 7 is illuminated by green light. Due to illumination by such green light, it is recognized by an operator that the correct winding operation of bobbin thread has been performed and such operation has been accepted by the control unit 22. At step S6, the sewing machine motor is started. Then, at step S7, it is judged whether or not the starting/stopping switch 11 is in an on-state. When the judgment is NO, then the system waits until the starting/stopping switch 11 is turned on. Then, if the judgment at step S7 is YES, the control sequence advances to step S8 at which the sewing machine motor is stopped. At step S9, the transparent filter 18 of the disk 14 of the color changing device 13 is positioned just below the light emitting portion of the sewing machine lamp 12. Consequently, the area of and around the upper face of the throat plate 7 is illuminated by natural light. Afterwards, the control sequence returns to step S2.

On the other hand, if it is judged at step S2 that the bobbin thread winding shaft 60 is not prepared for winding of bobbin thread, the control sequence advances to step S10 at which it is judged whether or not the starting/stopping switch 11 is in an on-state. When the starting/stopping switch 11 is not in an on-state, the control sequence returns to step S2. In contrast, when the starting/stopping switch 11 is in an on-state, the control sequence advances to step S11 at which it is judged whether or not an erroneous operation has been performed. Here, an erroneously operated condition is any of such conditions as listed below.

These conditions include: the starting/stopping switch is depressed to perform sewing while the presser foot is in its lifted position; when button hole stitching is to be performed, the starting/stopping switch is depressed without lowering the BH lever to its lower position; in any other sewing operation other than button hole stitching, the starting/stopping switch is depressed without returning the BH lever to its upper position; when it is necessary to lower the feed dog (e.g., button attaching pattern, embroidery), the starting/stopping switch is depressed while the feed dog is left at its upper position; and when the sewing machine is to be used while the feed dog is in its normal position, the starting/stopping switch 11 is depressed while the feed dog is in its lower position (dropping condition of the feed dog).

Accordingly, when it is judged at step S11 that some erroneous operation has been performed, contents of the erroneous operation are indicated on the indicating device 10 at step S12, and such indication is erased after lapse of a fixed interval of time. Subsequently, at step S13, the red filter 19 of the disk 14 of the color changing device 13 is positioned just below the light emitting portion of the sewing machine lamp 12. Consequently, the area of and around the upper face of the throat plate 7 is illuminated by red light. At step S14, it is judged whether or not the erroneous operation has been corrected. Here, correction of the erroneous operation is determined when the control unit 22 judges in accordance with signals received from the presser foot position sensor 26, BH lever position sensor 27 and feed dog position sensor 28 that the corresponding elements have returned to their respective regular positions. When the erroneous operation is not corrected, the sewing machine waits until it is corrected.

Subsequently, at step S15, it is judged whether or not there remains a sufficient amount of bobbin thread. When the judgment is NO, it is detected by the bobbin thread remaining amount detecting sensor 31 that there remains only an insufficiently small amount of bobbin thread and a bobbin thread remaining amount detection signal is transmitted to the control unit 22. Accordingly, when the judgment is NO, the control sequence advances to step S16 at which an indication of "remaining bobbin thread insufficient" is provided on the indicating device 10. At step S17, the yellow filter 20 of the disk 14 of the color changing device 13 is positioned just below the light emitting portion of the sewing machine lamp 12. The area of and around the upper face of the throat plate 7 is thus illuminated by yellow light. The illumination by yellow light and the indication of "remaining bobbin thread insufficient" are maintained until the operator exchanges the bobbin and a sufficient amount of bobbin thread is detected. Then, the control sequence advances to step S20.

On the other hand, when it is judged at step S15 that there remains a sufficient amount of bobbin thread, the judgment is YES, and the control sequence advances to step S18. At step S18, the area of and around the upper face of the throat plate 7 is illuminated by green light by way of the green filter 21 of the disk 14 of the color changing device 13. Simultaneously, if the indication of "remaining bobbin thread insufficient" remains on the indicating device, such indication is turned off. Due to such illumination by green light, it is recognized by the operator that the erroneous operation has been corrected and such correction has been accepted by the control unit 22. After lapse of a fixed interval of time, the transparent filter 18 is positioned just below the light emitting portion of the sewing machine lamp 12 at step S19. Then, at step S20, it is judged whether or not the starting/stopping switch 11 is in an on-state. If the judgment is NO, the machine waits until the starting/stopping switch 11 is turned on. If the starting/stopping switch 11 is in an on-state, the control sequence advances to step S21 at which the sewing machine motor is started, thus enabling sewing to begin.

On the other hand, when it is judged at step S11 that no erroneous operation has been performed, it is subsequently judged at step S22 whether or not there remains a sufficient amount of bobbin thread. If the latter judgment is NO, an indication of "remaining bobbin thread insufficient" is provided on the indicating device 10 at step S23, and the yellow filter 20 is positioned just below the light emitting portion of the sewing machine lamp 12 at step S24 in a similar manner as described above in connection with steps S16 and S17. The control sequence then advances to step S21. If it is judged at step S22 that there is a sufficient amount of remaining bobbin thread, the green filter 21 is positioned, at step S25, just below the light emitting portion of the sewing machine lamp 12 as the indication of "remaining bobbin thread insufficient" is turned off, thus causing illumination of the area of and around the upper face of the throat plate 7 by green light. Due to such illumination by green light, it is recognized by the operator that a correct operation has been performed and accepted by the control unit 22. Then, after the lapse of a fixed interval of time, the transparent filter 18 is positioned just below the light emitting portion of the sewing machine lamp 12 at step S26, whereafter the control sequence advances to step S21.

Figure 4B:
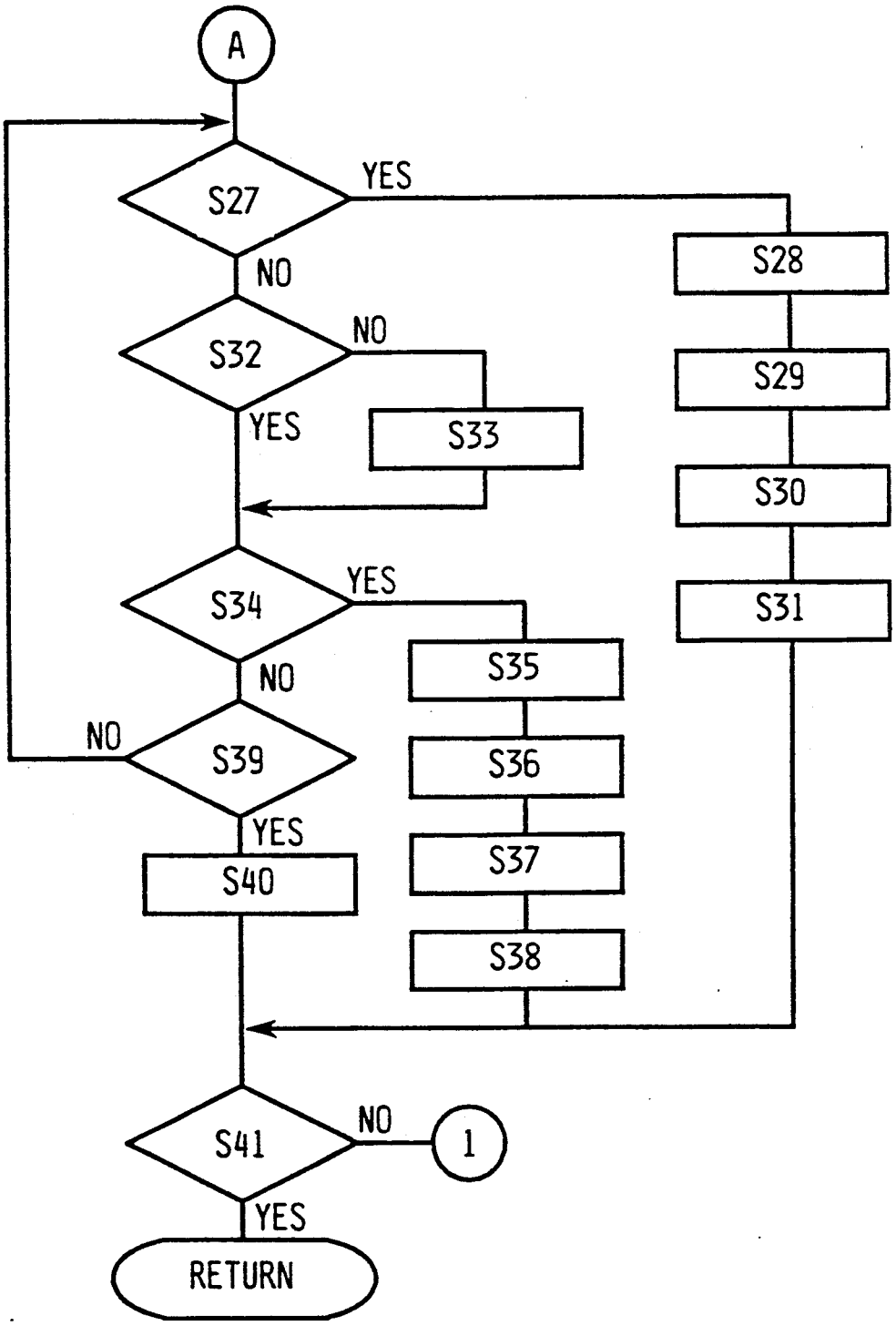

Referring now to FIG. 4B, at step S27 to which the control sequence advances from step S21 of FIG. 4A, it is judged whether or not the sewing machine motor 8 is in a locked condition. The sewing machine motor rotation sensor 32 detects such locked condition of the sewing machine motor 8 in accordance with a motor current or the like. If the locked condition of the sewing machine motor 8 is detected, a locked condition detection signal is transmitted to the control unit 22, and the sewing machine motor 8 is deenergized at step S28. At step S29, a message warning that the sewing machine motor 8 is in a locked condition is indicated on the indicating device 10, and after lapse of a fixed interval of time, the message is erased. At step S30, the red filter 18 of the disk 14 of the color changing device 13 is positioned just below the light emitting portion of the sewing machine lamp 12. Consequently, the area of and around the upper face of the throat plate 7 is illuminated by red light. At step S31, after the lapse of a fixed interval of time, the locked condition is corrected, the sewing machine motor 12 is rotated, and the transparent filter 18 is positioned just below the light emitting portion of the sewing machine lamp 12, illuminating the area of and around the upper face of the throat plate 7 by natural light. Subsequently, the control sequence advances to step S41.

On the other hand, if it is judged at step S27 that the sewing machine motor 8 is not in a locked condition, the control sequence advances to step S32. At step S32, it is detected by way of the bobbin thread remaining amount detecting sensor 31 whether or not there remains a sufficient amount of bobbin thread. If the amount of remaining bobbin thread is insufficient or excessively small, the control sequence advances at step S33 at which the yellow filter 20 is positioned just below the sewing machine lamp 12 so that the area of and around the upper face of the throat plate 7 is illuminated by yellow light as described hereinabove. Simultaneously, an indication of "remaining bobbin thread insufficient" is provided on the indicating device. Such illumination and indication are maintained until a sufficient amount of bobbin thread is detected. Afterwards, the control sequence advances to step S34.

At step S34, it is detected by way of the needle thread detecting sensor 30 whether or not the needle thread is broken. If the needle thread is broken, the sewing machine motor 8 is stopped at step S35, and an indication of "needle thread broken" is provided on the indicating device 10 at step S36. Then, at step S37, the red filter 19 is positioned just below the sewing machine lamp 12 so that the upper face of the throat plate 7 is illuminated by red light. Here, the operator will be made aware of breakage of the needle thread and thus re-sets the needle thread. After lapse of a fixed interval of time, the indication of "needle thread broken" is erased, and at step S38, the transparent filter 18 is positioned just below the sewing machine lamp 12 so that the area of and around the upper face of the throat plate 7 is illuminated by natural light. Afterwards, the control sequence advances to step S41.

In contrast, if it is judged at step S34 that the needle thread is not broken, then it is detected at step S39 whether or not the starting/stopping switch 11 is in an on-state. If the starting/stopping switch 11 is not in an on-state, the control sequence returns to step S27, but if the starting/stopping switch 11 is in an on-state, the control sequence advances to step S40 at which the sewing machine motor 8 is stopped. Then, the control sequence advances to step S41 at which it is judged whether or not the power source is in an off-state. If the power source is not in an off-state, the control sequence returns to step S2. If, however, the power source is in an off-state, the control sequence returns to the main routine.

With the sewing machine of the embodiment having such construction as described above, when an erroneous operation or an abnormal condition such as an accident is detected, the color of light emitted from the sewing machine lamp 12 which illuminates around the upper face of the throat plate is changed to red, for example, to give a warning. On the other hand, if the amount of remaining bobbin thread is decreased to a certain low level, the color of light emitted from the sewing machine lamp 12 is changed to yellow, for example, to attract the attention of the operator. Then, if a correcting operation is performed, then the color of light emitted from the sewing machine lamp 12 is changed to green, for example, by which the operator recognizes that the sewing machine has been operated correctly. Consequently, the operator is made aware of an erroneous operation, an abnormal condition, a warning, etc. rapidly and with certainty depending upon the color of light, and accordingly, such recognition is certain to take place.

Figure 5:
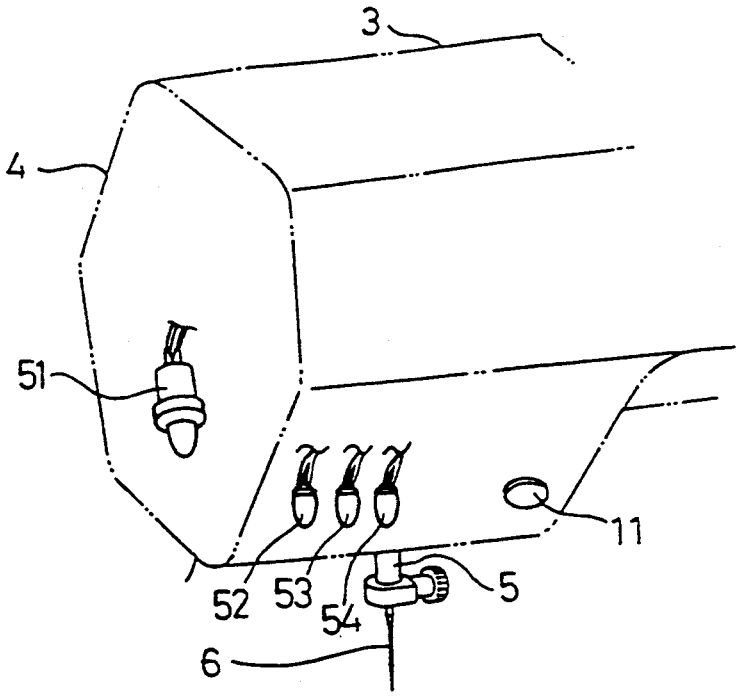
FIG. 5 is a perspective view showing sewing machine lamps of a sewing machine of a modified form.

A modification to the sewing machine described above is shown in FIG. 5. Referring to FIG. 5, the modified sewing machine includes, in place of the single sewing machine lamp 12 and the color changing device 13 of the sewing machine of the embodiment described above, a sewing machine lamp 51 for natural light, another sewing machine lamp 52 for red, a further sewing machine lamp 53 for yellow and a still further sewing machine lamp 54 for green. With the modified sewing machine, similarly as with the sewing machine of the embodiment described above, when an erroneous operation or an abnormal condition such as an accident or the like is detected, the red sewing machine lamp 52 is lit. When an attention of the operator is to be attracted such as when the amount of bobbin thread is decreased to a certain low level, the yellow sewing machine lamp 53 is lit. When the sewing machine is operated correctly, the green sewing machine lamp 54 is lit.

While the invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A sewing machine having a sewing area defined on a bed in which a sewing operation is performed by an operator, comprising:

illuminating means for illuminating the sewing area with light of different colors;

detecting means for detecting an abnormal condition of said sewing machine; and color changing means for changing, upon detection of an abnormal condition by said detecting means, the color of light radiated from said illuminating means to provide a warning of the abnormal condition to an operator.

2. The sewing machine according to claim wherein said illuminating means illuminates with a first color and at least one second color which is different from said first color, and said color changing means changes the color of light to be radiated from said illuminating means into said first color when said detecting means detects a normal condition in which a normal sewing operation is performed, and changes the color to be radiated from said illuminating means into said at least one second color when said detecting means detects at least one of an abnormal condition wherein the normal sewing operation is prohibited and an abnormal condition wherein the normal sewing operation will be discontinued in a short period of time.

3. The sewing machine according to claim 2, further comprising a throat plate which is mounted on an upper face of the bed, wherein said illuminating means illuminates toward said throat plate.

4. The sewing machine according to claim 2, wherein said illuminating means is mounted inside of a head section of said sewing machine.

5. The sewing machine according to claim 2, wherein said illuminating means includes a lamp and at least two filters adjacent to said lamp for illuminating with light of at least two different colors.

6. The sewing machine according to claim 2, wherein said illuminating means includes at least two lamps of different colors.

7. A sewing machine comprising:

illuminating means for illuminating with light toward a sewing area in which an operator performs sewing on a bed, said illuminating means illuminating with light of a first color and with light of a second color which is different from said first color;

detecting means for detecting two kinds of abnormal conditions, one kind being a condition wherein a normal sewing operation is prohibited and the other kind being a condition wherein a normal sewing operation will be discontinued in a short period of time; and warning means for selecting the color of light to be radiated from said illuminating means among said first color and said second color according to the kind of abnormal condition detected by said detecting means to provide a warning of said detected abnormal condition to an operator.

8. The sewing machine according to claim 7, wherein said warning means changes the color of light to said first color when said detecting means detects one of an abnormal condition wherein an erroneous operation has occurred as a result of incorrect preparation and an abnormal condition wherein a normal sewing operation has been discontinued, and wherein said warning means changes the color of light to said second color upon detection by said detecting means of an abnormal condition resulting in discontinuation of a sewing operation in a short period of time.

9. The sewing machine according to claim 8, wherein said first color is red and said second color is yellow.

10. The sewing machine according to claim 7, wherein said illuminating means further illuminates with light of a third color and said warning means changes the color of light to be radiated from said illuminating means into said third color when said detecting means detects a normal condition in which a normal sewing operation is performed.

11. The sewing machine according to claim 10, wherein said third color is green.

12. The sewing machine according to claim 10, wherein said illuminating means further illuminates with light of a natural color, said warning means changing the color of light from said illuminating means into said third color for a predetermined period of time and then changing the color of light from said third color to said natural color when said detecting means detects said normal condition.

13. The sewing machine according to claim 7, further comprising indicating means for providing a message representative of the particular abnormal condition detected by said detecting means.

14. The sewing machine according to claim 7, further comprising a throat plate which is mounted on an upper face of the bed, wherein said illuminating means illuminates toward said throat plate.

15. The sewing machine according to claim 7, wherein said illuminating means is mounted inside of a head section of said sewing machine.

16. The sewing machine according to claim 7, wherein said illuminating means includes a lamp and at least two filters adjacent to said lamp for illuminating with light of at least two different colors.

17. The sewing machine according to claim 7, wherein said illuminating means includes at least two lamps of different colors.

18. The sewing machine according to claim 8, wherein said detecting means detects that an erroneous operation has occurred as a result of incorrect preparation when said detecting means detects at least one of the conditions wherein a starting/stopping switch is depressed to perform sewing while a presser foot is in an upper position, the starting/stopping switch is depressed to perform button hole switching while a button hole lever is in a position other than a lower position, the starting/stopping switch is depressed to perform a sewing operation other than button hole stitching when a button hole lever is in a position other than an upper position, the starting/stopping switch is depressed to perform a button attaching pattern and embroidery when a feed dog is in an upper position, and the starting/stopping switch is depressed to perform a sewing operation other than a button attaching pattern and embroidery when a feed dog is in a lower position, said warning means selecting said first color when at least one of these conditions is detected.

19. The sewing operation according to claim 8, wherein said detecting means detects that a sewing operation has been discontinued when said detecting means detects at least one of the conditions wherein a sewing machine motor is in a locked condition and a needle thread is broken, said warning means selecting said first color when at least one of these conditions is detected.

20. The sewing operation according to claim 8, wherein said detecting means detects that a sewing operation will be discontinued in a short period of time when said detecting means detects that an insufficient amount of bobbin thread remains, said warning means changing the color of light to said second color upon said detection.

* * * * *